US006561681B1

(12) United States Patent
Huang

(10) Patent No.: US 6,561,681 B1
(45) Date of Patent: May 13, 2003

(54) STANDING DECORATIVE GARDEN LAMP

(76) Inventor: Ming-Hsien Huang, No. 2, Lane 65, Chang Kon Road, Hsinchu (TW)

( * ) Notice: Subject to any disclaimer, the term of this patent is extended or adjusted under 35 U.S.C. 154(b) by 0 days.

(21) Appl. No.: 10/045,142

(22) Filed: Jan. 15, 2002

(51) Int. Cl.[7] ..... F21V 3/00

(52) U.S. Cl. ..... 362/311; 362/153.1; 362/806; 362/431

(58) Field of Search ..... 362/311, 310, 362/806, 153.1, 351, 431, 414, 152, 153, 810

(56) References Cited

U.S. PATENT DOCUMENTS 5,398,180 A * 3/1995 Lee ..... 362/431
5,483,432 A * 1/1996 Wang ..... 362/431

* cited by examiner

*Primary Examiner*—Sandra O'Shea
*Assistant Examiner*—Ali Alavi
(74) *Attorney, Agent, or Firm*—Rosenberg, Klein & Lee

(57) ABSTRACT

The present invention relates to a standing decorative garden lamp, which mainly includes a decorative transparent tube with inner bulb assembly and a standing rod. The characteristic of the invention is to provide a connector to engage with top end of the standing rod directly while the connector is provided with side elastic slice for connecting with lower end of the tube in secure to obtain a firm engagement.

6 Claims, 2 Drawing Sheets

STANDING DECORATIVE GARDEN LAMP

BACKGROUND OF THE INVENTION

A conventional standing decorative garden lamp includes a transparent decorative tube and a standing rod, which inserts into ground while the tube is provided with some light assemblies inside. Since the tube is directly connected on the rod, the engagement between both can not be firm in order to replace the bulb assembly in the tube, as it is broken. It is found that the decorative tube of the prior garden lamp will be possibly loose when it is used. The tube may separate from the rod in accident that should be improved.

Accordingly, the primary object of the invention is to provide a standing decorative garden lamp, which is provided with a connector to firmly engage with the standing rod and to connect with the transparent decorative tube in secure for convenient utility. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
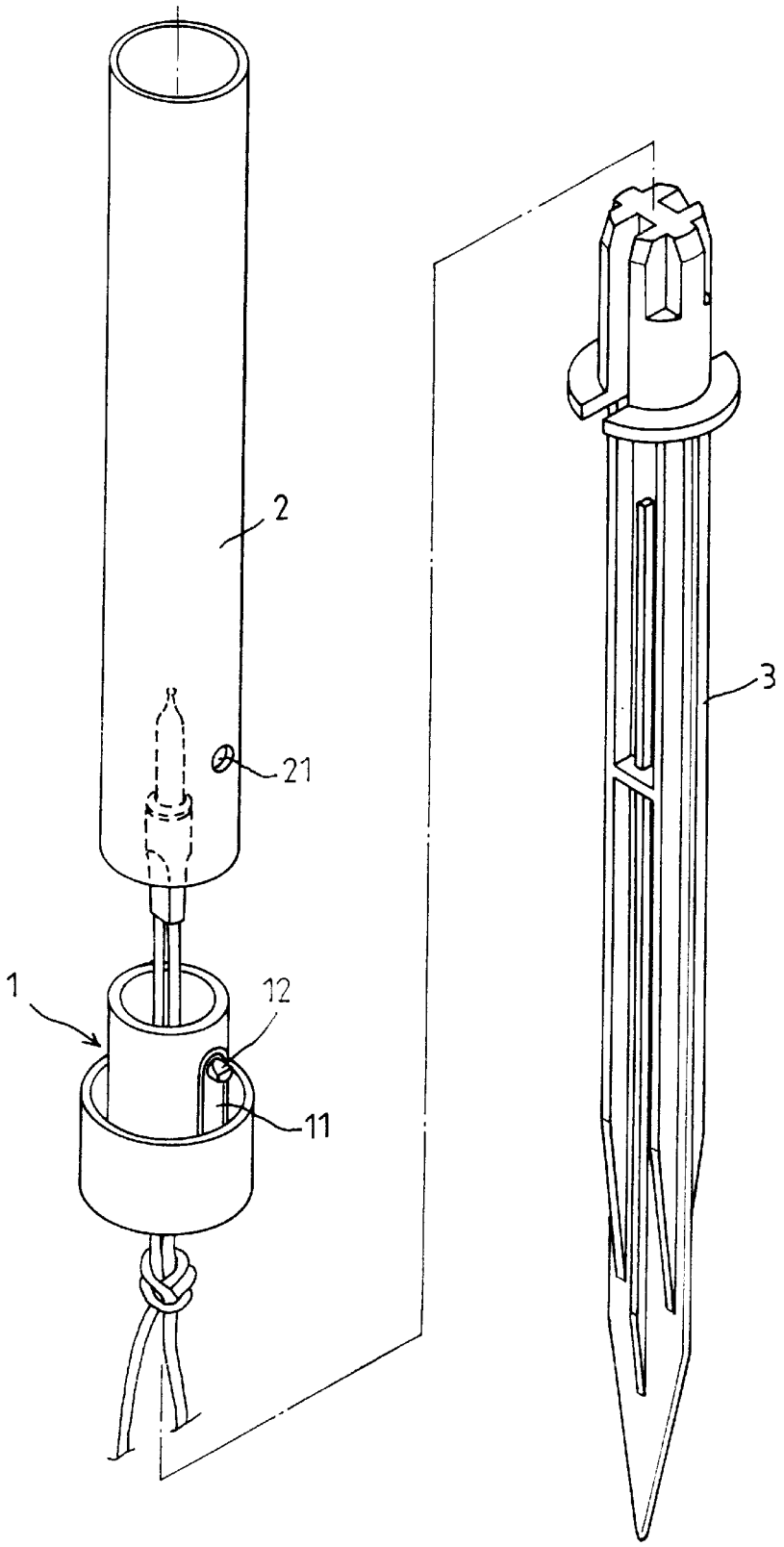
FIG. 1 is an exploded plan view showing a standing decorative garden lamp according to the present invention.

Please firstly refer to FIG. 1, the present invention mainly includes a decorative transparent tube (2), a standing rod (3), and a connector (1). The connector (1) is directly engaged with top end of the standing rod (3) in secure. The connector (1) is provided with a side elastic slice (11) having an outward protrusion (12). The transparent tube (2) is provided with a lower side hole (21), which can be engaged with the protrusion (12) of the elastic slice (11) when the lower end of the tube (2) is connected with the connector (1).

Figure 2:
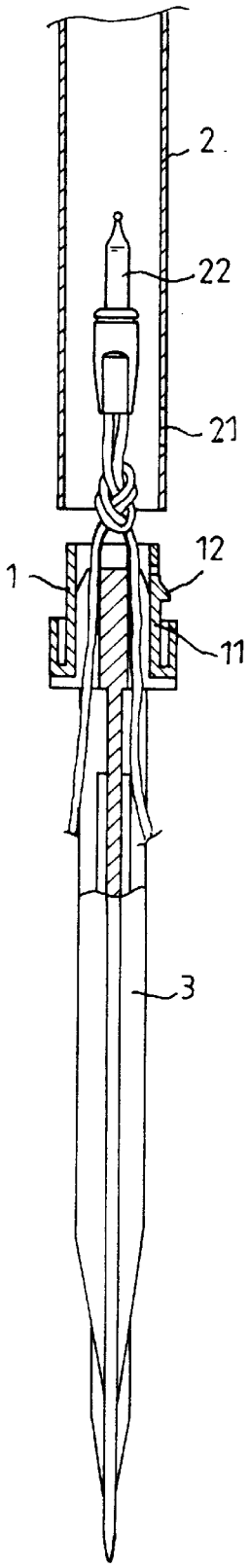
FIGS. 2 to 4 are cross-sectional plan views showing the assembly of FIG. 1 according to the present invention.
Figure 3:
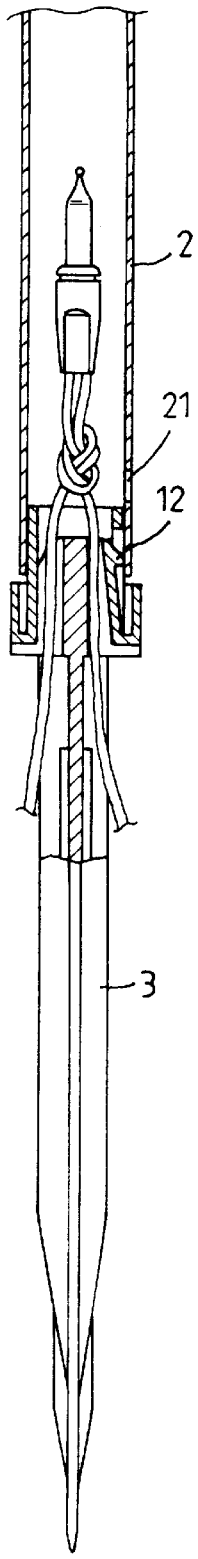
Figure 4:
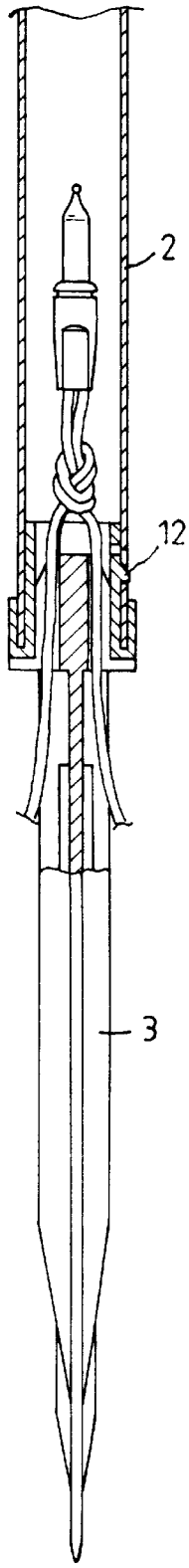

Referring to FIGS. 2 to 4, when the tube (2) is to connect with the connector (1), the bottom end of the tube (2) will contact the upper inclined surface of the protrusion (12) and can press the elastic slice (11) inward, as in FIG. 3. Until the connecting is completed, as in FIG. 4, the elastic slice (11) is recovered while the protrusion (12) engages with the hole (21).

According to the above connection, the connector (1) can be firmly engaged with the standing rod (3) and the decorative transparent tube (2) is also connected with the connector (1) in secure based by the engagement of the protrusion (12) of the elastic slice (11). That prevents from loose between each means and overcomes the drawback of the prior art. The embodiment in this description is only an example that will not be seem to limit the scope of the present invention. It is possible to modify or change a part of the structure based on this 20 invention, such as to provide with more than one elastic slice on the connector relating to holes provided on the decorative tube and that will be also claimed in the present invention.

When the bulb assembly must be replaced, a press on the protrusion (12) will push inward the elastic slice (11) and the tube (2) can be easily separated from the connector. It is very convenient and utilized.

What is claimed is:

1. A standing decorative garden lamp comprising:

(a) a substantially transparent tube having a lower side hole formed through a wall thereof, (b) a standing rod located in alignment with and in juxtaposition to said substantially transparent tube; and, (c) a connector mounted to said standing rod, said connector having a recess formed therein for insertion of said substantially transparent tube, said connector extending contiguously within said substantially transparent tube for frictionally engaging an inner wall of said substantially transparent tube, said connector having a radially displaceable elastic side slice with an outwardly directed protrusion member for insertion through said lower side hole thereby stably coupling said substantially transparent tube to said standing rod.

2. The standing decorative garden lamp as recited in claim 1 wherein said standing rod includes a platform member upon which said connector is positioned.

3. The standing decorative garden lamp as recited in claim 2 where said standing rod includes an upper section located above said platform, said connector being sandwiched between said upper section and said substantially transparent tube.

4. The standing decorative garden lamp as recited in claim 1 wherein said connector is substantially J-shaped in cross-sectional contour for receiving said substantially transparent tube.

5. The standing decorative garden lamp as recited in claim 1 wherein said connector is formed of an elastic composition.

6. The standing decorative garden lamp as claimed in claim 1 wherein said connector is provided with two of said radially displaceable elastic side slices, and said substantially transparent tube includes respective lower side holes for engagement with respective ones of said elastic side slices.

* * * * *